United States Patent [19]

Nedonchelle

[11] Patent Number: 4,581,161

[45] Date of Patent: Apr. 8, 1986

[54] AQUEOUS LIQUID DETERGENT COMPOSITION WITH DICARBOXYLIC ACIDS AND ORGANIC SOLVENT

[75] Inventor: Yvon J. Nedonchelle, Lille, France

[73] Assignee: Lever Brothers Company, New York, N.Y.

[21] Appl. No.: 690,281

[22] Filed: Jan. 10, 1985

[30] Foreign Application Priority Data

Jan. 17, 1984 [GB] United Kingdom ..... 8401182
Mar. 16, 1984 [GB] United Kingdom ..... 8406948

[51] Int. Cl.[4] ..... C11D 1/14; C11D 1/08

[52] U.S. Cl. ..... 252/550; 252/142; 252/143; 252/170; 252/174.19; 252/551; 252/554; 252/555; 252/559; 252/DIG. 14

[58] Field of Search ..... 252/106, 142, 143, 174.19, 252/550, 559, 551, DIG. 14

[56] References Cited

U.S. PATENT DOCUMENTS

| | | | |
|---|---|---|---|
| 3,993,575 | 11/1976 | Howanitz et al. | 252/142 |
| 4,247,408 | 1/1981 | Imamura et al. | 252/143 |
| 4,412,933 | 11/1983 | Klahr et al. | 252/174.19 |
| 4,465,612 | 8/1984 | Altenschopfer et al. | 252/143 |
| 4,469,525 | 9/1984 | Dodge | 134/3 |
| 4,501,680 | 2/1985 | Aszman et al. | 252/142 |

FOREIGN PATENT DOCUMENTS

| | | |
|---|---|---|
| 80749 | 6/1981 | European Pat. Off. . |
| 77111 | 6/1977 | Japan . |
| 35710 | 4/1978 | Japan . |
| 99106 | 8/1979 | Japan . |
| 28199 | 2/1982 | Japan . |
| 1285582 | 8/1972 | United Kingdom . |
| 1593111 | 7/1981 | United Kingdom . |

*Primary Examiner*—Prince E. Willis
*Attorney, Agent, or Firm*—James J. Farrell; Lynne Darcy

[57] ABSTRACT

An aqueous liquid detergent composition comprises, in addition to water, detergent active compound, at least one water-soluble dicarboxylic acid having from 5 to 7 carbon atoms in the molecule and having a solubility in water of from 1 to 70 g/100 g water at 20° C., and at least one organic solvent having a boiling point of from 120° to 280° C. and chosen from alkylene and polyalkylene glycols having from 2 to 9 carbon atoms in the molecule, and the $C_1$ to $C_4$ alkyl ethers thereof containing a total of from 3 to 14 carbon atoms in the molecule.

3 Claims, No Drawings

AQUEOUS LIQUID DETERGENT COMPOSITION WITH DICARBOXYLIC ACIDS AND ORGANIC SOLVENT

The invention relates to liquid detergent compositions, particularly compositions for cleaning hard surfaces.

Liquid detergent compositions for cleaning hard surfaces are generally classified into two types. The first are aqueous suspensions containing water-insoluble palpable abrasive particles; such compositions can suffer from a stability problem and tend to be gritty in use, such that the hard surface being cleaned can become scratched. The second are liquid detergent compositions, usually containing soap, fatty alkanolamide and alkyl benzene sulphonate, but with no palpable abrasive particles.

Liquid detergent compositions of the latter type, although free from the possible problem of scratching in use, nevertheless suffer from a number of drawbacks which can limit their consumer acceptability. Thus, they usually contain little or no detergency builder salts and consequently they tend to have poor cleaning performance on particulate soil, especially in areas where the water is hard. In addition, they can suffer from poor homogeneity and inadequate viscosity characteristics for consumer use. Moreover, the higher surfactant concentration necessary for in-use removal of grease and fatty soils can lead to extensive suds formation, which requires rinsing and wiping by the user. Although excessive suds production can be controlled to some extent by incorporation of a suds-regulating material such as hydrophobic silica and/or silicone or soap, this in itself can raise problems of poor product stability and homogeneity, and problems associated with deposition of insoluble particulate or soap residues on the items or surfaces being cleaned, leading to residual streaks and spots when the surface has dried.

It has been proposed in Japanese Patent Kokai No. 52-77111 (Kao Soap Co) to provide a detergent composition for bathroom use which includes one or more organic acids chosen from glycollic acid, lactic acid, citric acid, malic acid and malonic acid, together with a surfactant and a water-soluble solvent such as diethyleneglycol monobutyl ether. The detergency ability of these and other organic acids was compared and it is noted in particular that succinic acid performed very poorly and for this reason was rejected.

It has now been discovered that detergency can be improved in such a product suited to the cleaning of hard surfaces by the selection of an organic acid having a longer carbon chain and a lower solubility in water than the organic acids advocated by Kao Soap Co.

Accordingly, the invention provides an aqueous liquid detergent composition comprising, in addition to water, (a) from 0.2 to 20% by weight of detergent active compound chosen from synthetic anionic and nonionic detergent active compounds and mixtures thereof;

(b) from 0.5 to 15% by weight of at least one water-soluble dicarboxylic acid having from 5 to 7 carbon atoms in the molecule and having a solubility in water of from 1 to 70 g/100 g water at 20° C.; and (c) from 1 to 15% by weight of at least one organic solvent having a boiling point of from 120° to 280° C., and chosen from alkylene and polyalkylene glycols having from 2 to 9 carbon atoms in the molecule, and the $C_1$ to $C_4$ alkyl ethers thereof containing a total of from 3 to 14 carbon atoms in the molecule.

DETERGENT ACTIVE COMPOUND

The composition according to the invention will comprise detergent active compound chosen from synthetic anionic or nonionic detergent active compounds, or mixtures thereof.

Suitable synthetic anionic detergent active compounds are water-soluble salts of organic sulphuric reaction products having in their molecular structure an alkyl radical containing from 8 to 22 carbon atoms, and a radical chosen from sulphonic acid or sulphuric acid ester radicals and mixtures thereof. Examples of synthetic anionic detergents are sodium and potassium alkyl sulphates, especially those obtained by sulphating the higher alcohols produced by reducing the glycerides of tallow or coconut oil; sodium and potassium alkyl benzene sulphates such as those in which the alkyl group contains from 9 to 15 carbon atoms; sodium alkyl glyceryl ether sulphates, especially those ethers of the higher alcohols derived from tallow and coconut oil; sodium coconut oil fatty acid monoglyceride sulphates; sodium and potassium salts of sulphuric acid esters of the reaction product of one mole of a higher fatty alcohol and from 1 to 6 moles of ethylene oxide; sodium and potassium salts of alkyl phenol ethylene oxide ether sulphate with from 1 to 8 units of ethylene oxide molecule and in which the alkyl radicals contain from 4 to 14 carbon atoms; the reaction product of fatty acids esterified with isethionic acid and neutralised with sodium hydroxide where, for example, the fatty acids are derived from coconut oil and mixtures thereof.

The preferred water-soluble synthetic anionic detergent active compounds are the ammonium and substituted ammonium (such as mono, di and triethanolamine), alkaline metal (such as sodium and potassium) and alkaline earth metal (such as calcium and magnesium) salts of higher alkyl benzene sulphates and mixtures with olefinsulphonates and higher alkyl sulphates, and the higher fatty acid monoglyceride sulphates. The most preferred anionic detergent active compounds are higher alkyl aromatic sulphonates such as higher alkyl benzene sulphonates containing from 6 to 20 carbon atoms in the alkyl group in a straight or branched chain, particular examples of which are sodium salts of higher alkyl benzene sulphonates or of higher-alkyl toluene, xylene or phenol sulphonates, alkyl naphthalene sulphonates, ammonium diamyl naphthalene sulphonate, and sodium dinonyl naphthalene sulphonate.

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Particular examples include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol.

It is also possible optionally to include amphoteric or zwitterionic detergent actives in the compositions according to the invention.

Suitable amphoteric detergent-active compounds that optionally can be employed are derivatives of aliphatic secondary and tertiary amines containing an alkyl group of 8 to 18 carbon atoms and an aliphatic radical substituted by an anionic water-solubilising group, for instance sodium 3-dodecylamino-propionate, sodium 3-dodecylaminopropane sulphonate and sodium N-2-hydroxydodecyl-N-methyltaurate.

Suitable zwitterionic detergent-active compounds that optionally can be employed are derivatives of aliphatic quaternary ammonium, sulphonium and phosphonium compounds having an aliphatic radical of from 8 to 18 carbon atoms and an aliphatic radical substituted by an anionic water-solubilising group, for instance 3-(N,N-dimethyl-N-hexadecylammonium)propane-1-sulphonate betaine, 3-(dodecylmethyl sulphonium)propane-1-sulphonate betaine and 3-(cetylmethylphosphonium)ethane sulphonate betaine.

Further examples of detergent-active compounds are compounds commonly used as surface-active agents given in the well-known textbooks "Surface Active Agents", Volume I by Schwartz and Perry and "Surface Active Agents and Detergents", Volume II by Schwartz, Perry and Berch.

Preferably, the compositions contain both an anionic and a nonionic detergent active which are so chosen as to provide a structured liquid composition, i.e. one which is thickened without necessarily employing any thickening agent per se.

The amount of detergent active compound to be employed in the detergent composition of the invention will generally be from 0.2 to 20%, preferably from 2 to 10% by weight.

According to a particularly preferred embodiment of the invention, the detergent compositions will comprise from 2 to 6% by weight of a water-soluble, synthetic anionic sulphated or sulphonated detergent salt containing an alkyl radical of 8 to 22 carbon atoms in the molecule and from 1 to 4% by weight of an alkyleneoxylated nonionic detergent.

The weight ratio of anionic detergent to nonionic detergent in this particularly preferred embodiment may vary but is ideally in the range of from 1:1 to 4:1.

The Dicarboxylic Acid

The composition according to the invention will also comprise at least one water-soluble dicarboxylic acid which can function as a detergency builder, this acid having from 5 to 7 carbon atoms in the molecule, and having a solubility in water of from 1 to 70 g/100 g water at 20° C. It is apparent that the choice of a dicarboxylic acid having these characteristics improves the detergency of the composition and reduces its tendency to leave residual spots or streaks due to the production of excessive suds when employed to clean a surface, compared with similar compositions containing conventional detergency builders including other organic acids.

Preferred dicarboxylic acids as ω,ω-dicarboxylic acids having from 5 to 7 carbon atoms in the molecule, and with a solubility in water of from 1 to 70 g/100 g water at 20° C.

Examples of these preferred dicarboxylic acids are given in the table below together with their respective solubility in water:

| ω,ω-dicarboxylic acid | Carbon chain length | Solubility in water at 20° C. (g/100 g water) |
|---|---|---|
| glutaric acid | 5 | 63.9 |
| adipic acid | 6 | 1.4 |
| pimelic acid | 7 | 2.5 |

Dicarboxylic acids having a carbon chain length in excess of that of pimelic acid, such as suberic acid which has 8 carbon atoms in the molecule, have a very low solubility in water, and are accordingly not useful as efficient detergency builders. Dicarboxylic acids having a carbon chain length of less than that of glutaric acid, such as succinic acid which has 4 carbon atoms in the molecule, are on their own insufficiently effective as detergency builders, but they can be included in compositions accoring to the invention in order to enhance the effectiveness of the preferred dicarboxylic acids.

A particularly preferred mixture of water-soluble $C_5$ to $C_7$ω,ω-dicarboxylic acids, together with the $C_4$ω,ω-dicarboxylic acid, succinic acid, for use in detergent compositions according to the invention comprises from 25 to 35 parts by weight of adipic acid, from 40 to 50 parts by weight of glutaric acid and from 15 to 30 parts by weight of succinic acid.

The amount of dicarboxylic acid having from 5 to 7 carbon atoms in the molecule to be employed in compositions according to the invention is from 0.5 to 15%, preferably 1 to 5% by weight of the composition.

Organic Solvent

The composition according to the invention will also comprise at least one organic solvent having a boiling point of from 120° to 280° C. and chosen from alkylene and polyalkylene glycols having from 2 to 9 carbon atoms, and the $C_1$ to $C_4$ alkyl ethers thereof containing a total of from 3 to 14 carbon atoms.

Particular examples of these organic solvents with their respective boiling points at 760 mm Hg are given below:

| Organic Solvent | Boiling Point (°C.) |
|---|---|
| ethylene glycol | 198 |
| propylene glycol | 188 |
| trimethylene glycol | 213 |
| 1,2-butane diol | 192 |
| 1,3-butane diol | 204 |
| tetramethylene glycol | 235 |
| 1,2-pentane diol | 211 |
| 1,4-pentane diol | 220 |
| pentamethylene glycol | 260 |
| 2,3-hexane diol | 204 |
| hexamethylene glycol | 250 |
| ethylene glycol monoethyl ether | 135 |
| ethylene glycol mono-n-butyl ether | 171 |
| ethylene glycol monomethyl ether | 125 |
| ethylene glycol mono-n-butyl ether | 171 |
| diethylene glycol monoethyl ether | 195 |
| diethylene glycol mono-n-butyl ether | 231 |
| propylene glycol monomethyl ether | 120 |
| propylene glycol monoethyl ether | 131 |
| propylene glycol mono-n-butyl ether | 230 |
| dipropylene glycol monomethyl ether | 188 |
| dipropylene glycol monoethyl ether | 199 |
| dipropylene glycol mono-n-butyl ether | 247 |
| tripropylene glycol monomethyl ether | 242 |
| tripropylene glycol monoethyl ether | 253 |

Particularly preferred organic solvents are ethylene glycol mono-n-butyl ether, diethylene glycol mono-n-butyl ether, dipropylene glycol monomethyl ether and tripropylene glycol monomethyl ether.

The amount of the higher boiling point organic solvent to be used in compositions according to the invention is from 1 to 15%, preferably 2 to 10% by weight.

Water

The composition according to the invention will also comprise water which will generally form from 50 to 98.3%, preferably from 70 to 95% by weight of the composition.

Optional Ingredients

The compositions according to the invention can contain other ingredients which aid in their cleaning performance. For example, the compositions can contain detergent builders in addition to the dicarboxylic acids having from 5 to 7 carbon atoms in the molecule, provided that the detergency of the composition is not thereby impaired and the problem of spotting or streaking referred to earlier is not exacerbated. Preferred examples of such detergent builders include the nitrilotriacetates, polycarboxylates, citrates, water-soluble phosphates especially polyphosphates, mixtures of ortho- and pyrophosphate, zeolites and mixtures thereof. Metal ion sequestrants, including ethylenediaminetetraacetates, amino-polyphosphonates and phosphates (DEQUEST) and a wide variety of other poly-functional organic acids and salts, can also optionally be employed.

In general, the builder other than the specified dicarboxylic acid, and/or sequestrant when employed, preferably will form from 0.1 to 25% by weight of the composition.

A further optional ingredient for compositions according to the invention is soap, which can be employed as suds suppressors in compositions according to the invention which have a tendency to produce excessive suds in use. Soaps are salts of fatty acids and include alkali metal soaps such as the sodium, potassium, ammonium and alkanol ammonium salts of higher fatty acids containing preferably from 8 to 24 carbon atoms, and most preferably from 10 to 20 carbon atoms. Particularly useful are the sodium and potassium and mono-, di- and triethanolamine salts of the mixtures of fatty acids derived from coconut oil and ground nut oil.

When employed, the amount of soap can form at least 0.005%, preferably 0.5% to 2% by weight of the composition.

The compositions according to the invention can optionally contain thickening agents to aid in the distribution and adherence of them to the hard surface to be cleaned. Preferred thickeners include xanthan gum and other non-flocculating thickeners such as Biopolymer PS87 referred to in U.S. Pat. No. 4,329,448.

The amount of such thickeners, when employed, to be used in compositions according to the invention can be as little as 0.001%, preferably from 0.01 to 3% by weight of the composition.

The compositions according to the invention can also comprise at least partially esterified resin such as an at least partially esterified adduct of rosin and an unsaturated dicarboxylic acid or anhydride, or an at least partially esterified derivatives of co-polymerisation prodcts of mono-unsaturated aliphatic, cycloaliphatic or aromatic monomers having no carboxy groups and unsaturated dicarboxylic acids or anhydrides thereof.

Typical examples of suitable copolymers of the latter type are copolymers of ethylene, styrene, and vinylmethylether with maleic acid, fumaric acid, itaconic acid, citraconic acid and the like and the anhydrides thereof. Preferred are the styrene/maleic anhydride copolymers.

In general, the compositions of the invention can optionally comprise from 0.005 to 20%, usually from 0.1 to 15% and preferably from 0.5 to 10% by weight of the at least partially esterified resin.

Compositions according to the invention can also contain, in addition to the ingredients already mentioned, various other optional ingredients such as pH regulants, perfumes, dyes, optical brighteners, soil suspending agents, detersive enzymes, gel-control agents, freeze-thaw stabilisers, bactericides, preservatives and detergent hydrotropes.

Compositions according to the invention are usually formulated in the alkaline pH range, and will generally have a pH of from 8 to 11, preferably about 10 to 11. Alkalising agents such as sodium hydroxide and sodium carbonate can be used to adjust and buffer the pH as desired.

Since the compositions according to the invention are in liquid form, they can be prepared simply by blending the essential and optional ingredients in water.

The invention is illustrated by the following examples.

EXAMPLE 1

This example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3 |
| Ethoxylate fatty alcohol $C_{13-15}$.3EO | 1.5 |
| Water-soluble dicarboxylic acid | |
| Succinic acid, Glutaric acid, Adipic acid | 1.0 |
| Organic solvent | |
| Diethylene glycol mono-n-butyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

EXAMPLE 2

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3.15 |
| Ethoxylate fatty alcohol $C_{13-15}$.3EO | 1.35 |
| Water-soluble dicarboxylic acid | |
| Succinic acid, Glutaric acid, Adipic acid | 1.0 |
| Organic solvent | |
| Diethylene glycol mono-n-butyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and other soils, using a suitable applicator. It is generally unnecessary to rinse the surface afterwards with water.

EXAMPLE 3

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3 |
| Ethoxylate fatty alcohol $C_{13-15}$.3EO | 1.5 |
| Water-soluble dicarboxylic acid | |
| Succinic acid, Glutaric acid, Adipic acid | 1.0 |
| Organic solvent | |
| Ethylene glycol mono-n-butyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

EXAMPLE 14

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3.15 |
| Ethoxylate fatty alcohol $C_{13-15}$.3EO | 1.35 |
| Water-soluble dicarboxylic acid | |
| Succinic acid, Glutaric acid, Adipic acid | 1.0 |
| Organic solvent | |
| Ethylene glycol mono-n-butyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

EXAMPLE 5

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3 |
| Ethoxylate fatty alcohol $C_{13-15}$.3EO | 1.5 |
| Water-soluble dicarboxylic acid | |
| Succinic acid, Glutaric acid, Adipic acid | 1.0 |
| Organic solvent | |
| Dipropylene glycol monomethyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

EXAMPLE 6

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3.15 |
| Ethoxylate fatty alcohol $C_{13-15}$.3EO | 1.35 |
| Water-soluble dicarboxylic acid | |
| Succinic acid, Glutaric acid, Adipic acid | 1.0 |
| Organic solvent | |
| Dipropylene glycol monomethyl ether | 2.0 |
| Other ingredients | |

-continued

| INGREDIENTS | % w/w |
|---|---|
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

EXAMPLE 7

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3 |
| Ethoxylate fatty alcohol $C_{13-15}$.3EO | 1.5 |
| Water-soluble dicarboxylic acid | |
| Succinic acid, Glutaric acid, Adipic acid | 1.0 |
| Organic solvent | |
| Tripropylene glycol monomethyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

EXAMPLE 8

This Example illustrates the formulation of a self-opacifying concentrated detergent composition suitable for cleaning hard surfaces such as floors.

The formulation of this detergent concentrate was as follows:

| INGREDIENTS | % w/w |
|---|---|
| Detergent active | |
| Alkyl benzene sulphonate | 3.15 |
| Ethoxylate fatty alcohol $C_{13-15}$.3EO | 1.35 |
| Water-soluble dicarboxylic acid | |
| Succinic acid, Glutaric acid, Adipic acid | 1.0 |
| Organic solvent | |
| Tripropylene glycol monomethyl ether | 2.0 |
| Other ingredients | |
| Groundnut fatty acid | 0.5 |
| Alkalising agent (NaOH, $Na_2CO_3$) | 3.0 |
| Perfume, preservative, colour & mineral salts | qs |
| Water to | 100 |

This self opacified liquid detergent concentrate can be diluted with 100 times its volume of water and applied to floors or other hard surfaces in order to remove fat, oil and others soils, using a suitable applicator. It is generally unnecessary to rinse the surface afterwards with water.

I claim:

1. An aqueous liquid detergent composition comprising:

(i) from 2 to 6 weight% of an anionic detergent active compound selected from the group consisting of synthetic anionic sulphated and sulphonated detergent salts having an alkyl radical with from 8 to 22 carbon atoms;

(ii) from 1 to 4 weight% of a nonionic detergent active compound selected from the group consisting of condensation products of aliphatic alcohols having from 8 to 22 carbon atoms with from 2 to 15 moles of ethylene oxide;

(iii) from 0.5 to 15 weight% of ω,ω-dicarboxylic acids comprising a mixture of from 25 to 35 parts by weight of adipic acid, from 40 to 50 parts by weight of glutaric acid and from 15 to 30 parts by weight of succinic acid; and (iv) from 1 to 15 weight% of organic solvents, wherein said organic solvents comprise at least one organic solvent having a boiling point of from 120° to 280° C., selected from the group consisting of alkylene and polyalkylene glycols having from 2 to 9 carbon atoms in the molecule, and the $C_1$ to $C_4$ alkyl ethers thereof containing a total of from 3 to 14 carbon atoms in the molecule.

2. The detergent compositon of claim 1, wherein the weight ratio of the anionic detergent active compound and the nonionic detergent active compound is from 1:1 to 4:1.

3. The detergent composition of claim 1, wherein the organic solvent is selected from the group consisting of ethylene glycol mono-n-butyl ether, diethylene glycol mono-n-butyl ether, dipropylene glycol monomethyl ether, tripropylene glycol monomethyl ether, and mixtures thereof.

* * * * *